US009752455B2

(12) United States Patent
Stanka et al.

(10) Patent No.: US 9,752,455 B2
(45) Date of Patent: Sep. 5, 2017

(54) COMPONENT SUPPORT AND TURBOMACHINE

(71) Applicant: MTU Aero Engines AG, Munich (DE)

(72) Inventors: Rudolf Stanka, Rattenkirchen (DE); Christoph Lauer, Munich (DE); Hans Stricker, Munich (DE)

(73) Assignee: MTU Aero Engines AG, Munich (DE)

( * ) Notice: Subject to any disclaimer, the term of this patent is extended or adjusted under 35 U.S.C. 154(b) by 303 days.

(21) Appl. No.: 14/508,675

(22) Filed: Oct. 7, 2014

(65) Prior Publication Data

US 2015/0098799 A1 Apr. 9, 2015

(30) Foreign Application Priority Data

Oct. 8, 2013 (EP) ..... EP13187698

(51) Int. Cl.
*F01D 25/16* (2006.01)
*F01D 25/24* (2006.01)

(52) U.S. Cl.
CPC ..... *F01D 25/162* (2013.01); *F01D 25/246* (2013.01)

(58) Field of Classification Search
CPC ..... F01D 25/162; F01D 25/246; F01D 11/001
See application file for complete search history.

(56) References Cited

U.S. PATENT DOCUMENTS

| | | | | |
|---|---|---|---|---|
| 2,211,866 | A | 8/1940 | Soderberg | |
| 4,497,612 | A | 2/1985 | Knorowski et al. | |
| 4,688,385 | A | 8/1987 | Shibashita et al. | |
| 5,067,877 | A | 11/1991 | Youssef | |
| 5,554,005 | A | 9/1996 | Nguyen | |
| 5,580,218 | A | 12/1996 | Nguyen et al. | |
| 6,106,188 | A | 8/2000 | Krautzig et al. | |
| 6,352,405 | B1 * | 3/2002 | Tomko | F01D 25/265 415/209.2 |
| 7,513,747 | B2 | 4/2009 | Bachofner et al. | |
| 8,257,047 | B2 | 9/2012 | Mueller | |
| 2002/0006330 | A1 | 1/2002 | Pross et al. | |
| 2005/0002779 | A1 | 1/2005 | Tanaka | |
| 2013/0084188 | A1 | 4/2013 | Nagano et al. | |

FOREIGN PATENT DOCUMENTS

| | | |
|---|---|---|
| DE | 1062881 | 8/1959 |
| DE | 3407373 C2 | 6/1985 |
| DE | 69106820 T2 | 5/1995 |
| DE | 19728085 A1 | 1/1999 |
| EP | 0478234 A1 | 4/1992 |

(Continued)

*Primary Examiner* — Dwayne J White
*Assistant Examiner* — Aaron R Eastman
(74) *Attorney, Agent, or Firm* — Davidson, Davidson & Kappel, LLC

(57) ABSTRACT

A component support of the turbomachine, in particular an aircraft engine, is described, which includes at least two essentially annular components on the stator side, which are in axial contact with each other and are preferably oriented coaxially to the machine axis, the first component having a plurality of radial, groove-like recesses, which are laterally overlapped by the second component with its projection-like bearing sections, and an uncontoured support ring surface section being provided between the adjacent bearing sections, a turbomachine also being described.

13 Claims, 2 Drawing Sheets

(56) References Cited

FOREIGN PATENT DOCUMENTS

| | | | |
|---|---|---|---|
| EP | 1167696 | B1 | 1/2002 |
| FR | 2 887 920 | | 1/2007 |
| JP | 5918213 | A | 1/1984 |
| WO | WO2011102984 | A2 | 8/2011 |
| WO | WO 2013/163505 | | 10/2013 |

* cited by examiner

COMPONENT SUPPORT AND TURBOMACHINE

This claims the benefit of European Patent Application EP 131 87698.9, filed Oct. 8, 2013 and hereby incorporated by reference herein.

The present invention relates to a component support.

BACKGROUND

In turbomachines such as steam turbines, stationary gas turbines or aircraft engines, different thermal expansions and the same relative movements may occur between two stator-side components which are in contact with each other, due to vibrations. A known component support between two stator-side components which are in contact with each other is outlined in FIG. 1. The components are outlined therein only as details and in highly simplified form. The one component 1 is a housing ring, which is oriented coaxially to a machine axis X running in the plane of the drawing. The second component is, for example, an intermediate turbine housing, which is also oriented coaxially to machine axis X and is supported on a support ring surface 6 of the first component via a plurality of bearing sections 2, 4 extending radially to the outside. To avoid tilting effects between bearing sections 2, 4 and support ring surface 6, a plurality of recesses 8, 10, 12 are introduced into support ring surface 6, which are overlapped by bearing sections 2, 4 with their side edge areas 14, 16. Recesses 8, 10, 12 are spaced evenly apart in the circumferential direction, and are each spaced apart over an uncontoured support ring surface section 18, 20 which accommodates bearing sections 2, 4. They are oriented radially to machine axis X and thus in the direction of movement of the intermediate turbine housing. Recesses 8, 10, 12 are each groove-like and have two steep side walls 22, 24, which are connected to each other via a flat base 26. Transition areas 28, 30 between side walls 22, 24 and support ring surface sections 18, 20 have a relatively sharp-edged design. Although tilting effects may be at least reduced with the aid of these groove-like recesses, the groove-like recesses nevertheless result in a change in the structural mechanics of the housing ring in the area of the support ring surface. In addition, stresses may be introduced into the housing ring when introducing the recesses.

A turbomachine having an annular groove for accommodating a guide blade ring is illustrated in JP 5918213 A. The annular groove has a flat groove base and two steep side walls. Cavities are introduced into the transition areas between the side walls and the groove base.

SUMMARY OF THE INVENTION

It is an object of the present invention to provide an alternative component support of a turbomachine which eliminates the aforementioned disadvantages and in which a tilting effect between two stator-side components which are in contact with each other is prevented. Another alternate or additional object of the present invention is furthermore to provide a turbomachine having an optimized component support.

A component support of a turbomachine according to the present invention has at least two essentially annular components on the stator side, which are in axial contact with each other and are preferably provided coaxially to each other. The first component has a support ring surface and the second component has a plurality of bearing sections distributed over its circumference, via which it is in contact with the support ring surface. According to the present invention, a plurality of essentially radial, groove-like recesses are introduced into the support ring surface, each bearing section overlapping one recess with its two side edge areas, and an uncontoured support ring surface area extending between adjacent bearing sections.

Due to the support according to the present invention, tilting effects on the support ring surface and on the bearing sections during a relative movement of the components in relation to each other, for example due to different thermal expansions, are prevented. Due to the groove-like recesses, combined with the uncontoured support ring surface areas between the bearing sections, no significant change or no change in the structural mechanics of the first component occurs, so that no additional stresses are introduced into the first component, due to the groove-like recesses, not even when they are introduced into the first component. The groove-like recesses are furthermore easy to produce in terms of manufacturing. For example, the groove-like recesses are machined with the aid of a mechanical machining process such as milling or by an electrochemical or electroplating machining process.

In one preferred exemplary embodiment, the recesses have a depth-to-width ratio of 1:5 to 1:20. The depth is milled in the axial direction and the width in the circumferential direction. In one particularly favorable exemplary embodiment, the depth-to-width ratio is 1:10. The width is milled from a radial center plane of the recesses, so that the recesses have a total width which is equal to twice the width, similar to a diameter to a radius.

The recesses preferably have a total width which is 0.25 times to twice a width of the bearing sections.

An optimum adjustment of the first component to a support load to be accommodated may be achieved by the fact that the recesses each have different transition radii in the transition area to the uncontoured support ring surface areas and to support ring surface sections on which the bearing sections are supported or which accommodate the bearing sections.

In one alternative exemplary embodiment, the recesses each have the same transition radii in the transition area to the uncontoured support ring surface areas and to the support ring surface sections accommodating the bearing sections. Due to the same transition radii, an exemplary embodiment of this type is easier to manufacture than the preceding exemplary embodiment having the different transition radii.

From a structural mechanical perspective, it is favorable if the transition radii equal 0.1 times to 1 times a base radius of the recesses.

Alternatively, the transition areas from the recesses to the uncontoured support ring surface areas and to the support ring surface sections accommodating the bearing sections may be designed as chamfers or edges. Chamfers or edges are easy to provide in terms of manufacturing.

In one exemplary embodiment, the base radius is interrupted by a flat spot.

The at least two components are advantageously oriented coaxially to each other.

In particular, the at least two components may be provided with a rotationally symmetrical design. This facilitates the orientation of the components with respect to each other.

A turbomachine according to the present invention has at least one component support according to the present invention, with the aid of which tilting effects between stator-side components which are in contact with each other are prevented.

BRIEF DESCRIPTION OF THE DRAWINGS

One preferred exemplary embodiment of the present invention is explained in greater detail below on the basis of schematic representations.

DETAILED DESCRIPTION

Figure 1:
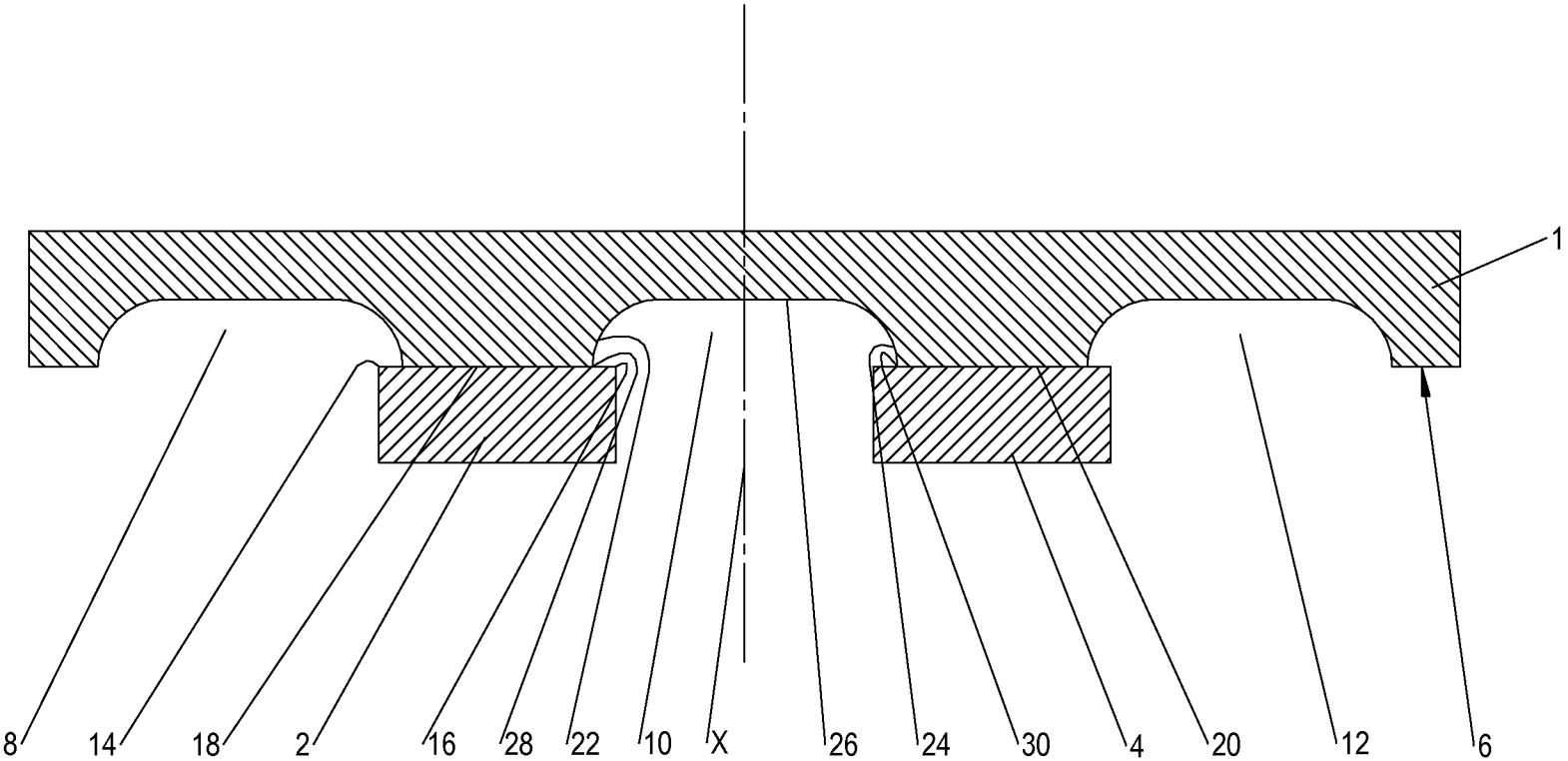
Prior art Fig. 1
FIG. 1 shows a detail of a known support for two components of a turbomachine.
Figure 2:
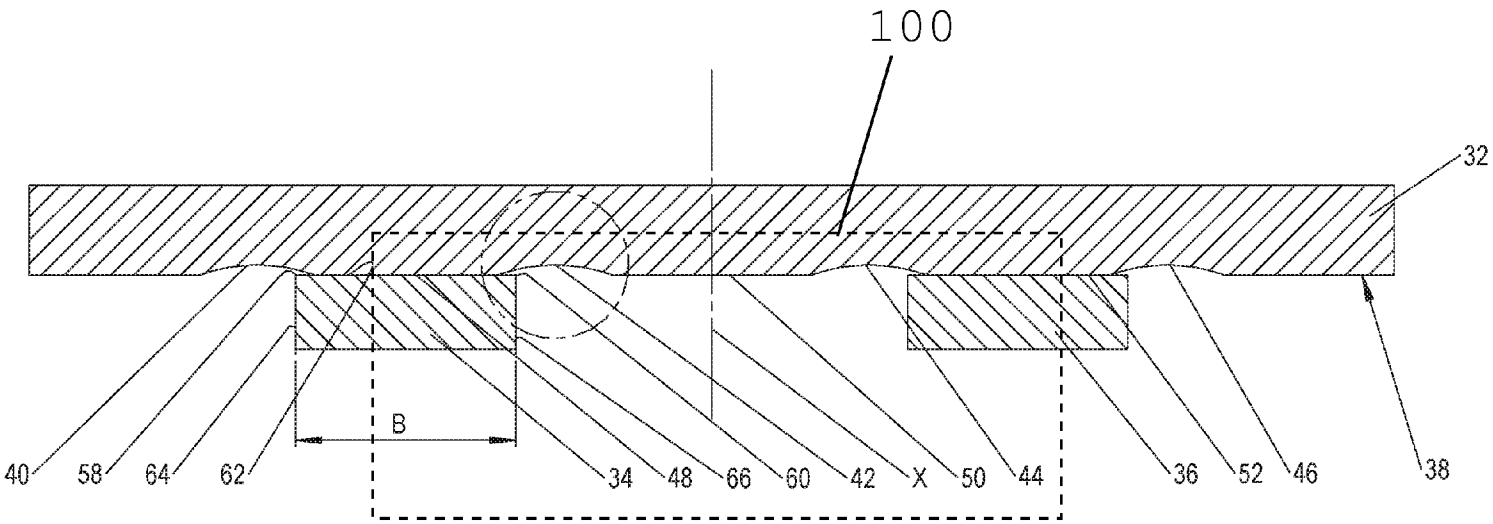
FIG. 2 shows a detail of a component support of a turbomachine according to the present invention.

FIG. 2 shows a detail of a component support of a turbomachine according to the present invention. The turbomachine is preferably a stationary gas turbine and, in particular, an aircraft engine. The component support is situated in the turbomachine on the turbine side and is formed, for example, from an annular housing 32 on the stator side and an annular intermediate turbine housing 100 (shown schematically) on the stator side. The intermediate turbine housing has a plurality of projections 34, 36, which extend therefrom radially to the outside and which act as bearing sections and with the aid of which the intermediate turbine housing is supported on an axial support ring surface 38 of housing 32. In the exemplary embodiment illustrated herein, housing 32 and the intermediate turbine housing are oriented rotationally symmetrically and coaxially to machine axis X of the turbomachine, which extends in the plane of the drawing and orthogonally to support ring surface 38.

To avoid tilting effects in the area of bearing sections 34, 36, a plurality of groove-like recesses 40, 42, 44, 46 are introduced into support ring surface 38. Recesses 40, 42, 44, 46 are spaced evenly apart in the circumferential direction, and are spaced apart over uncontoured support ring surface areas 48, 50, 52.

In the sense of the present invention, the term "uncontoured" means that support ring surface areas 48, 50, 52 essentially continue an original contour of support ring surface 38. Of course, local indentations are included in support ring surface areas 48, 50, 52. Support ring surface areas 48, 50, 52 may also have a manufacturing-induced surface roughness which is not smoothed or is smoothed only in sections by reworking. For example, the surfaces of support ring surface areas 48, 52 which support bearing sections 34, 36 may be or may have been smoothed using finishing steps such as fine grinding and/or using coatings, while the surface of intermediate support ring surface area 50 essentially has a manufacturing-induced, original surface roughness.

Bearing sections 34, 36 are distributed evenly over the circumference of the intermediate turbine housing 100. They have a distribution in the circumferential direction in such a way that they each rest against a support ring surface area 48, 52 and are spaced apart over a support ring surface area 50. An uncontoured support ring surface area 50 thus always exists between adjacent bearing sections 34, 36. For reasons of clarity, support ring surface areas 48, 52 on which bearing sections 34, 36 are supported are referred to as support ring surface sections. Support ring surface areas 50 which are free of bearing sections are referred to as support ring surface regions.

For reasons of clarity, only left bearing section 34 illustrated in FIG. 2 is provided with a corresponding reference numeral in the following. Bearing sections 34, 36 have an extension in the circumferential direction or width B in such a way that they overlap a recess 40, 42 with their side edge areas 58, 60. As a result, bearing sections 34, 36 with their side edge areas 58, 60 are spaced apart from support ring surface 38, so to speak, so that side edge areas 58, 60 are unable to dig into the housing or may not themselves become damaged during a relative movement of the intermediate turbine housing with respect to housing 32. Bearing sections 34, 36 have a rectangular cross section, including a flat contact surface 62, via which they are in contact with particular support ring surface section 48, 52, and two side surfaces 64, 66, which extend in the radial direction and which each form side edge areas 58, 60 together with contact surface 62.

Figure 3:
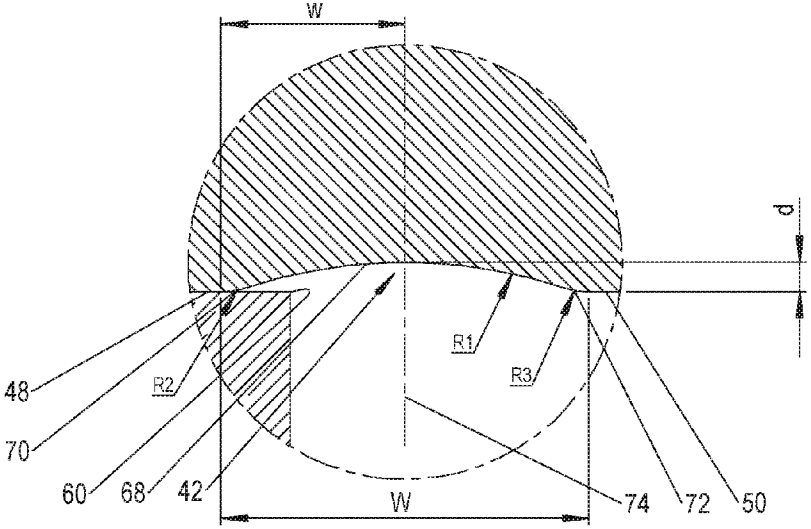
FIG. 3 shows a detailed representation from FIG. 2.

As is illustrated in the detailed representation in FIG. 3 on the basis of recess 42, which is representative of all recesses 40, 42, 44, 46, recesses 40, 42, 44, 46 each have a groove-like profile and extend in the radial direction with respect to machine axis X. They are thus oriented in the direction of a relative movement of the intermediate turbine housing. The groove-like contour is constant in the radial direction. They each have a base 68, which has a base radius R1 which, in the exemplary embodiment illustrated herein, runs directly into particular support ring surface section 48 and support ring surface region 50. Recesses 40, 42, 44, 46, so to speak, thus do not have side walls, or the side walls of recesses 40, 42, 44, 46 merge continuously or are flush with base 68. Transition areas 70, 72 between recesses 40, 42, 44, 46 and particular support ring surface section 48 and support ring surface region 50 are preferably each provided with a transition radius R2, R3.

Recesses 40, 42, 44, 46 have a depth-to-width ratio d:w of 1:5 to 1:20, preferably approximately 1:10. Width w is milled from a radial center plane 74 of recesses 40, 42, 44, 46. The depth is milled from the intersection area of center plane 74 with base 68 to adjacent support ring surface section 48 or support ring surface region 50. Recesses 40, 42, 44, 46 preferably have a total width W which is 0.25 times to twice width B of bearing sections 34, 36. Depth-to-width ratio d:w is set, in particular, via base radius R1.

Base radius R1 may be interrupted by a flat spot, which is not illustrated.

Transition radii R2, R3 may be provided with the same design, as in the exemplary embodiment illustrated herein. In one alternative exemplary embodiment, which is not illustrated, transition radii R2, R3 are different. Transition radii R2, R3 preferably correspond to 0.1 times to 1 times base radius R1. Alternatively, transition areas 70, 72 may be designed as chamfers or edges.

In addition to the use of the component support according to the present invention explained herein by way of example for supporting an intermediate turbine housing, the component support may, of course, also be used on other stator-side components. In particular, the components may be non-rotationally symmetrical.

A component support of the turbomachine, in particular an aircraft engine, is described, which includes at least two essentially annular components on the stator side, which are in axial contact with each other and are preferably oriented coaxially to the machine axis, the first component having a plurality of radial, groove-like recesses which are laterally overlapped by the second component with its projection-like bearing sections, and an uncontoured support ring surface section being provided between the adjacent bearing sections, a turbomachine also being described.

LIST OF REFERENCE NUMERALS

1 Housing ring

2 Projection/bearing section

4 Projection/bearing section
6 Support ring surface
8 Groove-like recess
10 Groove-like recess
12 Groove-like recess
14 Side edge area
16 Side edge area
18 Support ring surface section
20 Support ring surface section
22 Side wall
24 Side wall
26 Base
28 Transition area
30 Transition area
32 Housing
34 Bearing section
36 Bearing section
38 Support ring surface
40 Recess
42 Recess
44 Recess
46 Recess
48 Support ring surface area/support ring surface section
50 Support ring surface area/support ring surface region
52 Support ring surface area/support ring surface section
58 Side edge area
60 Side edge area
62 Contact surface
64 Side surface
66 Side surface
68 Base
70 Transition area
72 Transition area
74 Center plane
R1 Base radius
R2 Transition radius
R3 Transition radius
B Width of bearing section
d Depth of recess
w Width of recess, milled from center line
W Total width of recess
X Machine axis

What is claimed is:

1. A component support of a turbomachine, the component support comprising:

at least first and second annular components on a stator side of the turbomachine, the first and second annular components in axial contact with each other, the first annular component having a support ring surface, and the second annular component having a plurality of bearing sections distributed over a circumference, the second annular component being in contact with the support ring surface via the bearing sections distributed over the circumference, the support ring surface having a plurality of radial groove recesses, the recesses have a depth-to-width ratio of 1:5 to 1:20, each bearing section having two side edge areas each overlapping one of the recesses and an uncontoured support ring surface area extending between adjacent bearing sections, the uncontoured support ring surface continuing an original contour of the support ring surface.

2. The component support as recited in claim 1 wherein the recesses have a depth-to-width ratio of 1:10.

3. The component support as recited in claim 1 wherein the recesses have a total width 0.25 times to twice a width of the bearing sections.

4. The component support as recited in claim 1 wherein the recesses each have different transition radii in a transition area to the uncontoured support ring surface regions and to the support ring surface sections accommodating the bearing sections.

5. The component support as recited in claim 4 wherein the transition radii correspond to 0.1 times to 1 times a base radius of the recesses.

6. The component support as recited in claim 1 wherein the recesses each have same transition radii in the transition area to the uncontoured support ring surface regions and to the support ring surface sections accommodating the bearing sections.

7. The component support as recited in claim 6 wherein the transition radii correspond to 0.1 times to 1 times a base radius of the recesses.

8. The component support as recited in claim 1 wherein transition areas from the recesses to the uncontoured support ring surface regions and to the support ring surface sections accommodating the bearing sections are designed as chamfers or edges.

9. The component support as recited in claim 1 wherein a base radius of the recesses is interrupted by a flat spot.

10. The component support as recited in claim 1 wherein the first and second stator-side components are oriented coaxially to each other.

11. The component support as recited in claim 1 wherein the first and second stator-side components are provided with a rotationally symmetrical design.

12. A turbomachine comprising a component support as recited in claim 1.

13. A component support of a turbomachine, the component support comprising:

an annular housing on a stator side of the turbomachine;

an intermediate turbine housing on the stator side;

the annular housing and the intermediate turbine housing being in axial contact with each other, the annular housing having a support ring surface, and the intermediate turbine housing having a plurality of bearing sections distributed over a circumference, the intermediate turbine housing being in contact with the support ring surface via the bearing sections distributed over the circumference, the bearing sections being projections extending radially from the outside of the intermediate turbine housing, the annular housing and the intermediate turbine housing being oriented rotationally symmetrically and coaxially to a machine axis of the turbomachine;

the support ring surface having a plurality of radial groove recesses, the recesses have a depth-to-width ratio of 1:5 to 1:20, each bearing section having two side edge areas each overlapping one of the recesses and an uncontoured support ring surface area extending between adjacent bearing sections, the uncontoured support ring surface continuing an original contour of the support ring surface.

* * * * *